US006176390B1

(12) United States Patent
Kemp

(10) Patent No.: US 6,176,390 B1
(45) Date of Patent: Jan. 23, 2001

(54) CONTAINER LID WITH COOLING RESERVOIR

(76) Inventor: Douglas R. Kemp, 167 Forsythia Ct., Quakertown, PA (US) 18951-2736

( * ) Notice: Under 35 U.S.C. 154(b), the term of this patent shall be extended for 0 days.

(21) Appl. No.: 09/385,173

(22) Filed: Aug. 30, 1999

(51) Int. Cl.[7] ..... A47G 19/22

(52) U.S. Cl. ..... 220/712; 220/711; 229/906.1; 222/454

(58) Field of Search ..... 220/711, 712, 220/713, 703, 254, 367.1, 368; 222/454; 229/906.1

(56) References Cited

U.S. PATENT DOCUMENTS

| | | | | |
|---|---|---|---|---|
| 3,806,023 | * | 4/1974 | Barnett | 229/404 |
| 4,146,157 | | 3/1979 | Dixon et al. | 222/424 |
| 4,318,500 | * | 3/1982 | Melikian | 222/425 |
| 4,503,992 | | 3/1985 | Sitko et al. | 220/90.4 |
| 4,589,569 | * | 5/1986 | Clements | 220/380 |
| 4,619,372 | * | 10/1986 | McFarland | 220/90.4 |
| 4,738,373 | * | 4/1988 | DeParales | 220/254 |
| 4,795,052 | | 1/1989 | Hayes, Jr. | 220/90.2 |
| 5,090,584 | | 2/1992 | Roberts et al. | 220/712 |
| 5,415,312 | | 5/1995 | Mueller | 220/254 |
| 5,490,609 | * | 2/1996 | Lane et al. | 220/712 |
| 5,529,179 | | 6/1996 | Hanson | 206/219 |
| 5,624,053 | * | 4/1997 | Freek et al. | 220/713 |
| 5,699,927 | * | 12/1997 | Lane et al. | 220/254 |
| 5,722,558 | | 3/1998 | Thompson | 220/521 |
| 5,839,601 | * | 11/1998 | Van Melle | 220/712 |
| 5,894,952 | | 4/1999 | Mendenhall et al. | 220/713 |

* cited by examiner

*Primary Examiner*—Stephen F. Gerrity
*Assistant Examiner*—Rhonda E. Sands
(74) *Attorney, Agent, or Firm*—Imre Balogh

(57) ABSTRACT

Container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

5 Claims, 5 Drawing Sheets

CONTAINER LID WITH COOLING RESERVOIR

BACKGROUND OF THE INVENTION

1. Field of the Invention

This invention relates generally to a disposable beverage container lid made of a plastic material designed to cover a container containing a hot beverage therein, such as tea or coffee. More particularly, the invention relates to a disposable container lid having an integral cooling reservoir with a small opening in the side wall portion thereof, allowing the hot beverage to partially fill and quickly cool in the reservoir thereby preventing burn of the user's mouth from the first sips of the beverage.

2. Reported Developments

The prior art has provided lids/closures/covers for disposable and non-disposable containers, such as take-out cups used in the fast food services. The objects of the prior art included convenient and safe handling of hot or cold beverages without spill from containers, especially in containers carried in moving vehicles. As a result, anti-spill lids were suggested and/or provided for beverage containers such as disclosed for examples in U.S. Pat. Nos. 4,146,157 and 5,415,312.

Other references disclose detachable covers for a drinking cup having a mouth or orifice enabling the user to drink the liquid without removing the cap form the container, such as disclosed for example in U.S. Pat. No. 4,503,992.

Another reference, U.S. Pat. No. 5,090,584 discloses a multi-function cap lid for disposable beverage containers where the lid has a means for retaining a flap in an open and non-interfering position when the liquid in the beverage container is being consumed by a consumer.

Still other references, such as U.S. Pat. Nos. 5,529,179, 5,722,558 and 5,894,952 disclose condiment reservoirs integral with the lid of beverage containers for convenience of the user to consume the condiments therefrom or to place the condiments from the reservoir into the liquid contained in the beverage container from which the condiment is consumed along with the beverage.

While providing anti-spill lids for take-out beverage containers, the prior art apparently has not satisfactorily addressed the need to prevent burn of the mouth and lips of the consumer when initially sipping hot coffee or tea. Plastic and paper cups are good insulators and maintain the temperature of a hot beverage for extended periods of time. However, the itinerant consumer in a motor vehicle would wish to sip the hot beverage without waiting for the hot beverage to cool down to a temperature at which it is safe to drink without the risk of burning his or her mouth or lips.

Accordingly, the present invention is directed to the provision of a hot beverage cup lid which allows safe sipping of the hot beverage from an associated cup.

SUMMARY OF THE INVENTION

In accordance with the present invention, there is provided a cup lid with a means to contain a small volume of a hot beverage which allows cooling and safe sipping of the beverage from an associated disposable cup. The cup lid comprises:

a planar top surface;

an outer rim extending around the planar top surface;

a recess in the planar top surface adjacent to the outer rim; and a closure tab in the planar top surface positioned away from the recess in said planar top surface; wherein the recess in the planar top surface forms a cooling reservoir which comprises:

a conical side wall having an open proximal end terminating in a rim, a distal end connected to a closed bottom, wherein said conical side wall has an opening therein designed to allow a beverage to pass therethrough and into said cooling reservoir.

In another aspect, the present invention provides a cup lid with a means to cool a small volume of a hot beverage in combination with a disposable cup containing the hot beverage.

The combination comprises the cup lid as described above and a disposable cup which includes:

a disposable cup having a generally conical configuration having a distal end and a proximal end. The distal end terminates in a flat, horizontal bottom portion closing the cylindrical side wall and forming a cup therewith. The proximal end of the cup is open to receive a hot beverage and terminates in a circular rim which extends slightly away from the side wall and is adapted to engage the outer rim of the cup lid having a skirt thereon.

DETAILED DESCRIPTION OF THE INVENTION

Figure 1:
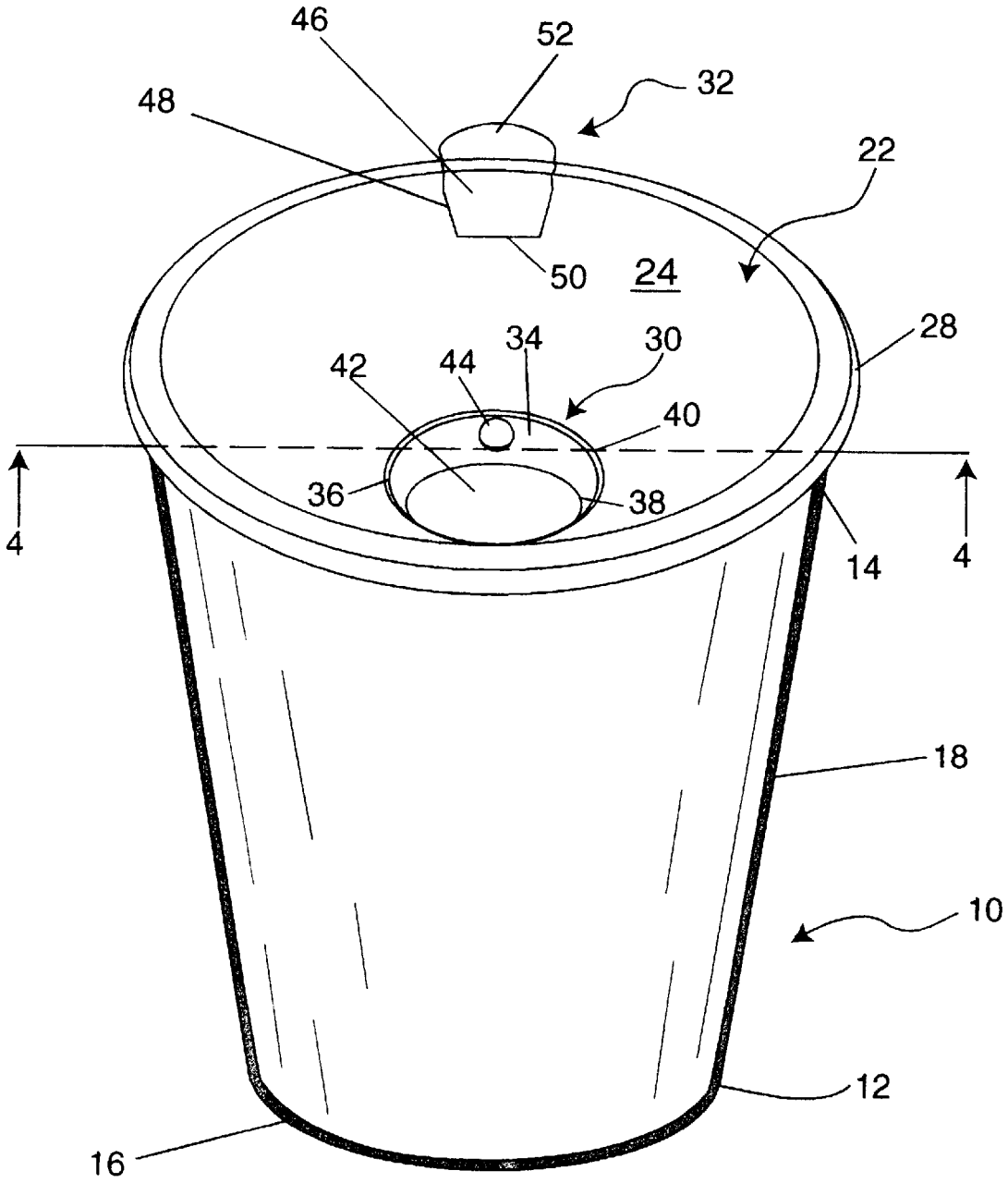
FIG. 1 illustrates in perspective view the typical lid of the present invention positioned on a cup, the lid having a reservoir therein and a closure tab thereon, the closure tab being in the closed position.

Referring to FIGS. 1 through 5 of the drawings, there is shown a disposable container 10 hereinafter referred to as cup, typically made of polystyrene, or paper coated with a thin polymeric material. Disposable cup 10 is of generally conical configuration having a distal end 12 and a proximal end 14. The distal end terminates in a flat, horizontal bottom portion 16 closing the cylindrical side wall 18 and forming a cup therewith. The proximal end is open to receive a beverage and terminates in a circular rim 20 which extends slightly away from side wall 18 of the cylindrical cup.

Cup lid generally designated by the reference numeral 22 is releasably mounted on proximal end 14 of cup 10 closing the opening thereof. The cup lid is made of a plastic material, such as polystyrene marketed under the trademark STYROFOAM®, or treated paper. Cup lid 22 comprises: a planar top surface 24 and a planar bottom surface 26; an outer rim 28 extending around the planar top surface 24 which, when cup lid 22 is mounted on cup 10, provides for snap-on secure attachment of cup lid 22 to cap 10; a recess in cup lid 22 forming a cooling reservoir generally designated by the numeral 30 constituting the main feature of the present invention, and a closure tab 32, diagonally positioned away from cooling reservoir 30.

Cooling reservoir 30 comprises a conical side wall 34 having an open proximal end 36 and a distal end 38. Proximal end 36 terminates in rim 40 which preferably is at level with the planar top surface 24 of cup lid 22, although rim 40 may be at a level a few millimeters higher than the planar top surface 24 of cup lid 22. Conical side wall 34 at the distal end 38 thereof connects to closed bottom 42.

Cooling reservoir 30 is designed to receive of from about 1 ml to about 10 ml or more of the hot beverage contained in disposable cup 10. Conical side wall 34 of cooling reservoir 30 contains an opening 44 therein through which the hot beverage enters from the disposable cup 10. The size of the opening may be of from about 0.5 to about 3 mm when the opening is circular; or of from about 0.3 mm to about 7 mm when the opening is rectangular.

Closure tab generally designated by the numeral 32 is positioned in the planar top and bottom surfaces 24 and 26 of cup lid 22 opposite from cooling reservoir 30 and comprises: an access strip 46; tear indentations 48 which provides for easy separation of the access strip from cup lid 22; hinge 50 which allows the closure tab to flex upon tearing the closure tab indentations away from the surface of the cup lid; and pull tab 52 which is integral with access strip 46 and facilitates the tearing back of the access strip from cup lid 22.

Figure 2:
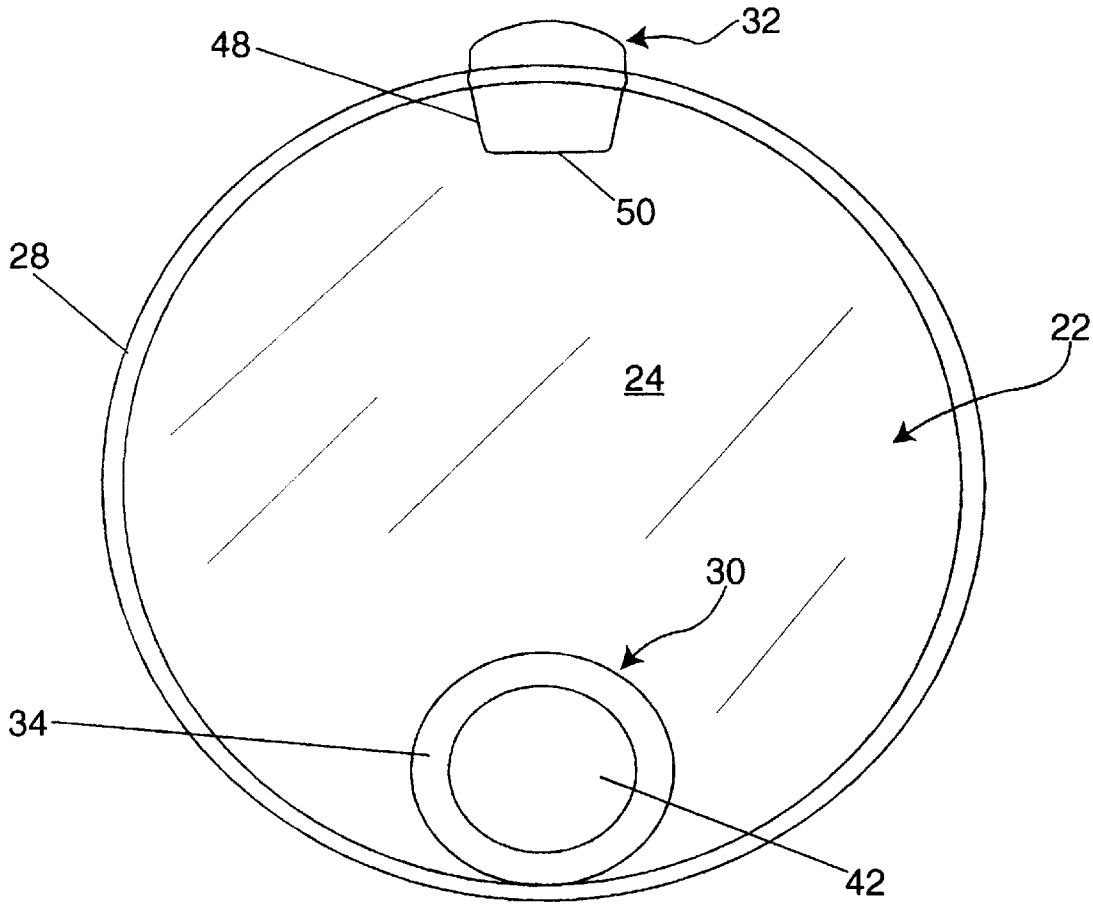
FIG. 2 is a top view of the present invention show in FIG. 1.
Figure 3:
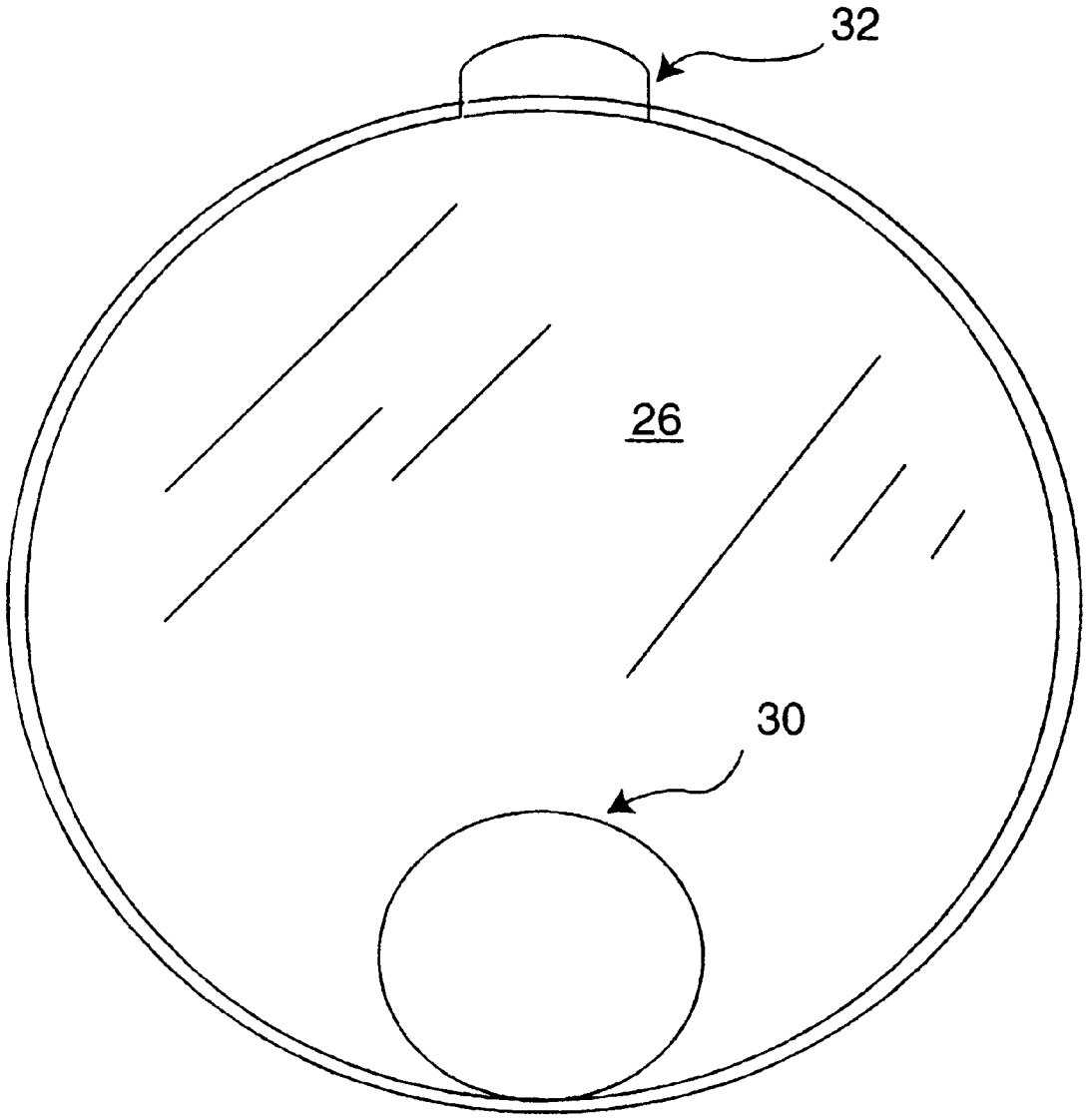
FIG. 3 is a bottom view of the present invention shown in FIG. 1.
Figure 4:
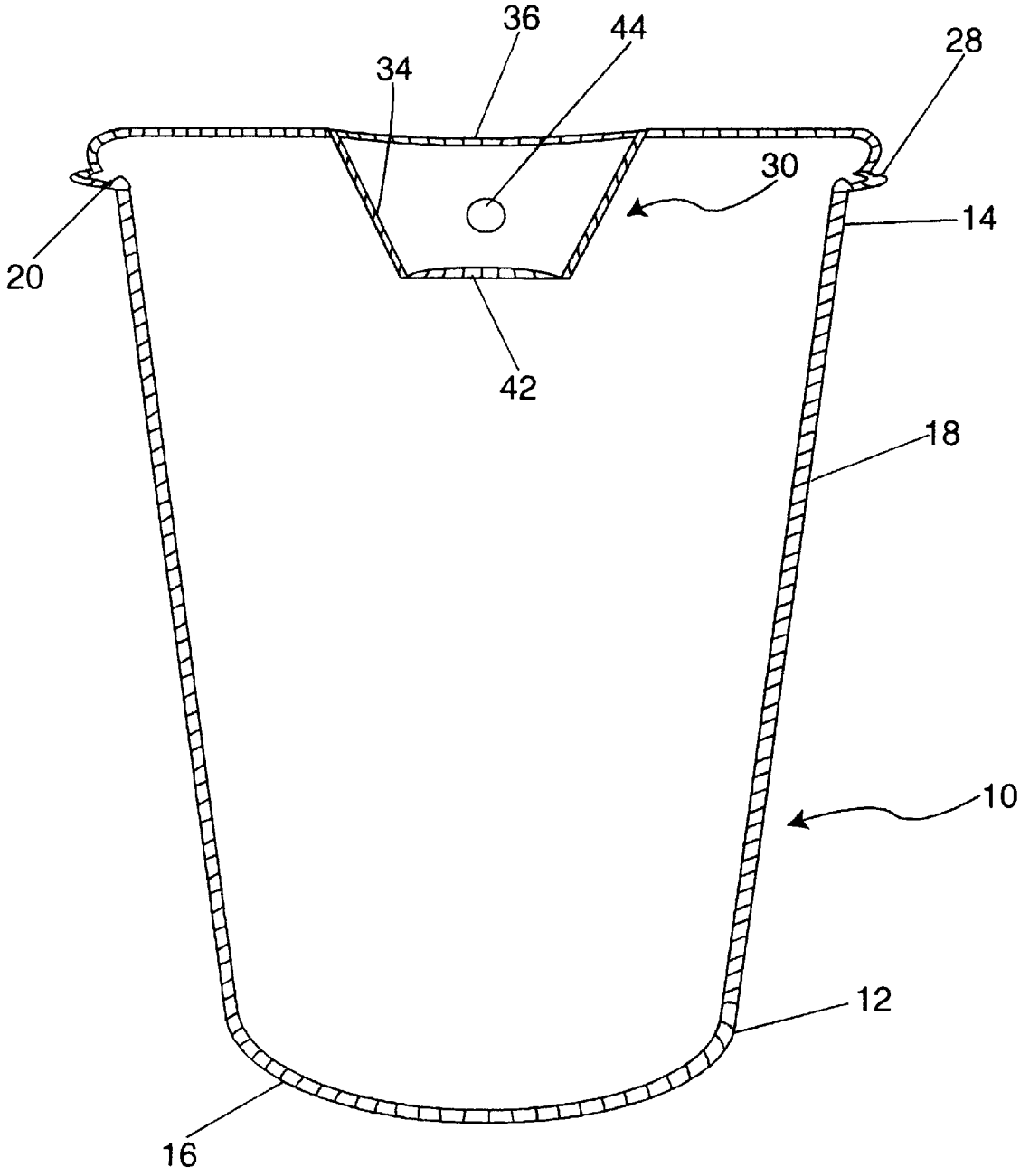
FIG. 4 is a cross-sectional view of the present invention positioned on the cup taken along the line 4—4 of FIG. 1.
Figure 5:
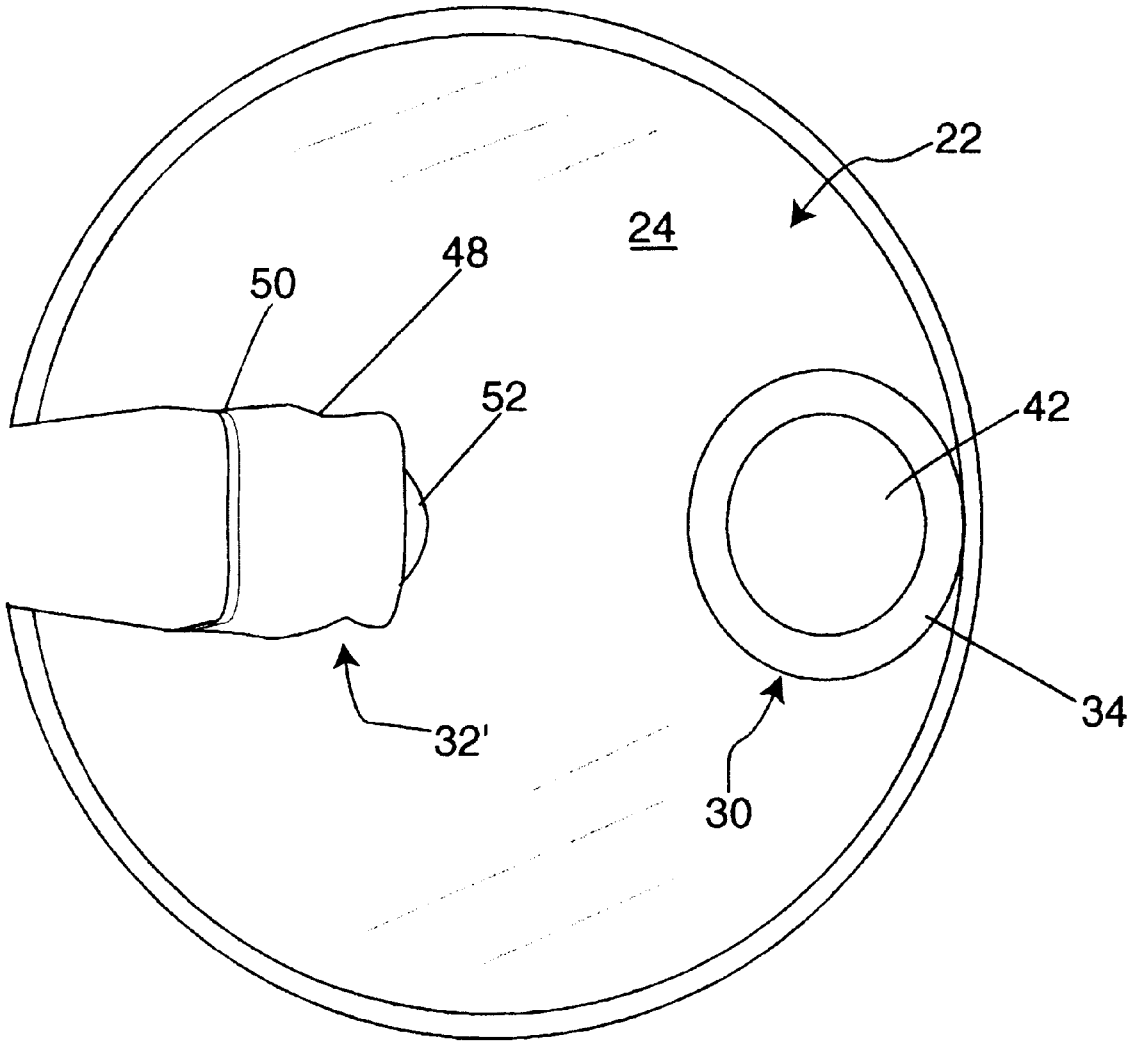
FIG. 5 is a top view of the present invention shown in FIG. 1 with the closure tab being in the open position.

In use the disposable cup 10 is filled with the hot beverage, such as hot coffee or tea. Cup lid 22 is placed on the cup by pressing the outer rim of cup lid with skirt 28 thereon against the rim 20 of the cup 10 and snapping the cup lid in place. At this time the closure tab 32 is in the closed position as shown in FIGS. 1, 2 and 3. The consumer being in a stationary position or in a moving vehicle holds the cup with the cooling reservoir towards him/her and slightly tilts the cup from its vertical position thereby allowing the hot beverage to enter into the cooling reservoir through the opening in the side wall thereof. Because only a relatively small amount of the hot beverage can be contained in the cooling reservoir, the hot beverage quickly cools down allowing the consumer to sip the beverage without waiting. The cooling reservoir only allows a small volume of the beverage to remain therein even if the cooling reservoir is completely filled initially, since any volume above the opening in the side wall of the cooling reservoir simply flows back to the cup.

After sufficient time has elapsed and the hot beverage in the disposable cup is cool enough, the consumer may wish to drink the beverage the conventional way, i.e. by holding the pull tab 52 and peeling back the access strip on the closure tab 46 along tear indentations 48 and bending it along hinge 50 towards the cooling reservoir.

| PARTS LIST | |
|---|---|
| Disposable container or cup | 10 |
| Distal end of cup | 12 |
| Proximal end of cup | 14 |
| Bottom portion of cup | 16 |
| Side wall of cup | 18 |
| Circular rim on proximal end of cup | 20 |
| Cup lid, generally designated, in closed position | 22 |
| Cup lid, generally designated, in open position | 22' |
| Planar top surface of cup lid | 24 |
| Planar bottom surface of cup lid | 26 |
| Outer rim of cup lid with skirt | 28 |
| Cooling reservoir in lid, generally designated | 30 |
| Closure tab, generally designated | 32 |
| Conical side wall of cooling reservoir | 34 |
| Proximal end of conical side all of cooling reservoir | 36 |
| Distal end of conical side wall of cooling reservoir | 38 |
| Rim of cooling reservoir | 40 |
| Closed bottom of cooling reservoir | 42 |
| Opening in side wall of cooling reservoir | 44 |

-continued

| PARTS LIST | |
|---|---|
| Access strip on closure tab | 46 |
| Tear indentations in access strip | 48 |
| Hinge of access strip | 50 |
| Pull tab on access strip | 52 |

Having described the invention, it is apparent that changes and modifications may be made therein without departing from the spirit and scope of the invention.

What is claimed is:

1. A cup lid with a cooling reservoir in combination with a disposable cup containing a hot beverage therein, wherein said cup lid comprises:

a) a planar top surface having an outer rim extending around the planar top surface;

b) a recess in the planar top surface adjacent to said outer rim; and c) a closure tab in the planar top surface positioned adjacent to said outer rim diagonally away from said recess in said planar top surface; wherein said closure tab having an access strip with tear indentations attached to said planar top surface of said cup lid allowing flexing of said closure tab backwards toward said cooling reservoir and thereby creating a large opening in said cup lid; wherein said recess in the planar top surface forms a cooling reservoir for a hot beverage comprising:

a conical side wall having an open proximal end terminating in a rim, and a distal end connected to a closed bottom, wherein said conical side wall has an opening therein to allow a hot beverage to pass therethrough and into said cooling reservoir;

wherein said cup lid is removable and attached to a disposable cup which comprises:

a generally conical side wall having a distal end terminating in a flat, horizontal bottom portion closing the conical side wall and forming a cup therewith; and a proximal open end to receive a hot beverage terminating in a circular rim which extends slightly away from said side wall and engages said outer rim of said cup lid having a skirt thereon, wherein said cooling reservoir cools said hot beverage therein prior to consumption and said large opening in said planar top surface allows consumption of the hot beverage when it cools to a safe temperature.

2. The cup lid with a cooling reservoir in combination with a disposable cup of claim 1 wherein said cup lid is made of a material selected from the group consisting of a polymer and a treated paper.

3. The cup lid with a cooling reservoir in combination with a disposable cup of claim 2 wherein said polymer is polystyrene.

4. The cup lid with a cooling reservoir in combination with a disposable cup of claim 1 wherein said cooling reservoir has a capacity to receive a volume of from about 1 ml to about 10 ml of a hot beverage.

5. The cup lid with a cooling reservoir in combination with a disposable cup of claim 1 wherein said opening in said cooling reservoir is circular having a diameter of from about 0.5 mm to about 3 mm.

* * * * *